US012478847B2

(12) United States Patent
Cyr

(10) Patent No.: US 12,478,847 B2
(45) Date of Patent: Nov. 25, 2025

(54) APPARATUS FOR IMPROVING AND FINE-TUNING THE SCORING SKILLS OF A HOCKEY PLAYER

(71) Applicant: Jean Marc Cyr, Oshawa (CA)

(72) Inventor: Jean Marc Cyr, Oshawa (CA)

( * ) Notice: Subject to any disclaimer, the term of this patent is extended or adjusted under 35 U.S.C. 154(b) by 366 days.

(21) Appl. No.: 17/953,540

(22) Filed: Sep. 27, 2022

(65) Prior Publication Data

US 2023/0096946 A1 Mar. 30, 2023

Related U.S. Application Data

(60) Provisional application No. 63/248,754, filed on Sep. 27, 2021.

(51) Int. Cl.
*A63B 69/00* (2006.01)
*A63B 63/00* (2006.01)

(52) U.S. Cl.
CPC ..... *A63B 69/0024* (2013.01); *A63B 63/004* (2013.01)

(58) Field of Classification Search
CPC ..... A63B 69/0024; A63B 63/004
USPC ..... 473/446
See application file for complete search history.

(56) References Cited

U.S. PATENT DOCUMENTS

| | | | | |
|---|---|---|---|---|
| 6,899,645 | B1 * | 5/2005 | Hsiao | A63B 63/004 473/446 |
| 7,762,912 | B2 * | 7/2010 | Lewis | A63B 69/0002 473/422 |
| 7,811,184 | B2 * | 10/2010 | Siefker | A63B 63/004 473/422 |
| 8,529,382 | B2 * | 9/2013 | Green | A63B 71/0619 473/454 |
| 9,028,346 | B2 * | 5/2015 | Melin | A63B 69/002 473/446 |
| 9,457,249 | B2 * | 10/2016 | Goldberg | A63B 63/004 473/446 |
| 2023/0096946 | A1 * | 3/2023 | Cyr | A63B 69/0024 473/446 |

* cited by examiner

*Primary Examiner* — Mitra Aryanpour
(74) *Attorney, Agent, or Firm* — McDonald Hopkins LLC

(57) ABSTRACT

An apparatus for use in conjunction with a goal having a frame defining an opening is provided. The apparatus includes at least two movable blockers adapted to selectively define a target space within the opening. First and second blockers are perpendicular and mounted on portions of the frame. The first blocker has a pair of opposed horizontal first free edges defining a first free space between the first free edges and movable in a vertical direction to increase or decrease the first free space therebetween. The second blocker has a pair of opposed vertical second free edges defining a second free space between the second free edges and movable in a horizontal direction to increase or decrease the second free space therebetween. The first free space and the second free space define the target space.

20 Claims, 6 Drawing Sheets

APPARATUS FOR IMPROVING AND FINE-TUNING THE SCORING SKILLS OF A HOCKEY PLAYER

RELATED APPLICATIONS

This application claims the benefit of U.S. Provisional Patent Application Ser. No. 63/248,754 filed Sep. 27, 2021 and entitled Apparatus for Improving and Fine-Tuning the Scoring Skills of a Hockey Player, the entire contents of which are hereby incorporated by reference herein for all purposes.

FIELD OF THE DISCLOSURE

The present disclosure relates generally to sports equipment and, more specifically, to an apparatus for improving and fine-tuning the scoring skills of a hockey player, the apparatus having at least two movable blockers shaped and sized to define a target space within an opening of a goal.

BACKGROUND OF THE DISCLOSURE

Most hockey players train with a training net as shown in FIG. 1. A training net can be configured to include a plurality of stationary and/or motionless targets. For example, each target can include a hole formed in a panel mounted in a front frame of the training net. For example, a target can have a circular, rectangular or any desirable shape, but the shape of the target does not change during the training session. For example, the targets can be positioned to simulate areas which cannot be protected by a goalie.

SUMMARY OF THE DISCLOSURE

According to one aspect, there is disclosed an apparatus for use in conjunction with a goal having a frame defining an opening, the opening being substantially rectangular, the apparatus including:

at least two movable blockers shaped and sized to block the opening when in a fully closed configuration, the blockers being adapted to selectively define a target space within the opening when in a partially open configuration; and a first blocker mounted on a portion of the frame, the first blocker having a pair of opposed first free edges defining a first free space between the free edges, the opposed first free edges being generally horizontal and movable to increase or decrease the first free space therebetween, the free edges being further movable in a vertical direction for vertically adjusting the first free space;

a second blocker mounted on another portion of the frame and being generally perpendicular to the first blocker, the second blocker having a pair of opposed second free edges defining a second free space between the second free edges, the opposed second free edges being generally vertical and movable to increase or decrease the second free space therebetween, the second free edges being further movable in a horizontal direction thereby adjusting the second free space;

the first free space and the second free space defining the target space.

DETAILED DESCRIPTION OF THE DISCLOSURE

The present subject matter will be further described below with reference to the accompanying drawings.

Figure 1:
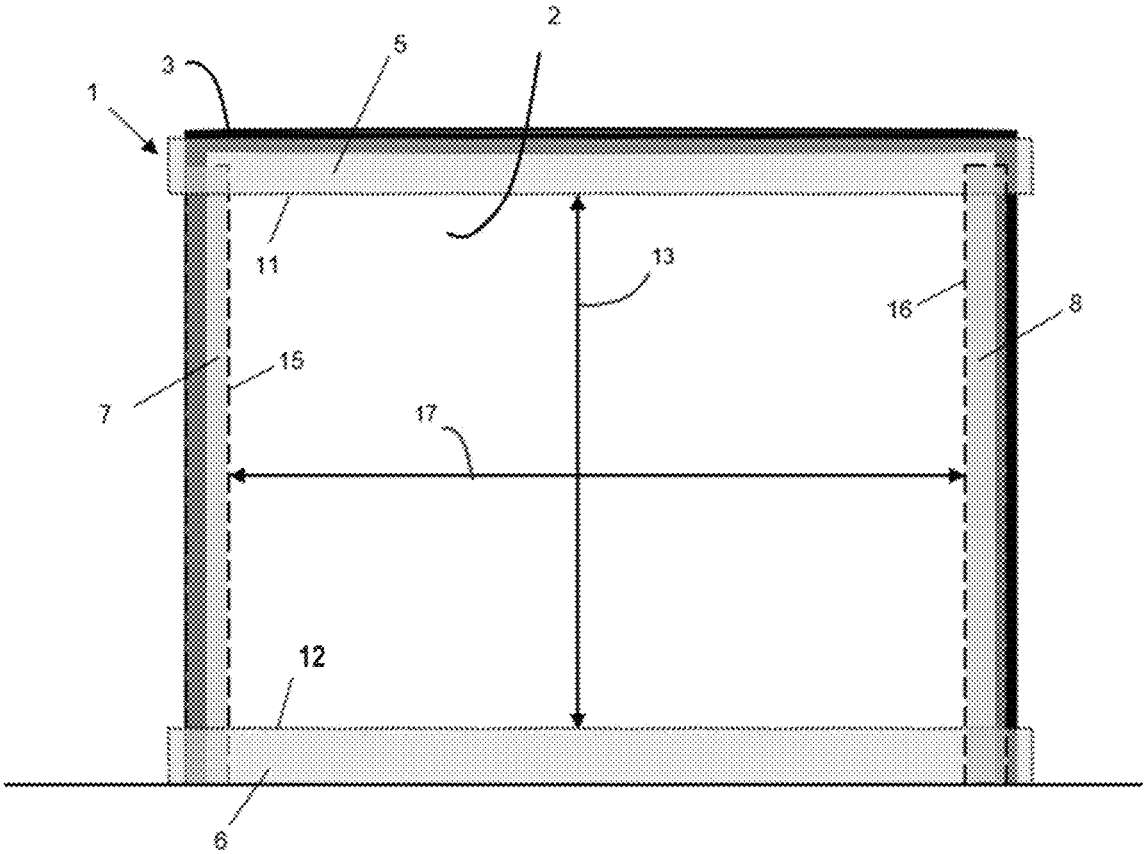
FIG. 1 is an illustrative view of an apparatus for improving and fine-tuning the scoring skills of a hockey player, according to one example.
Figure 2:
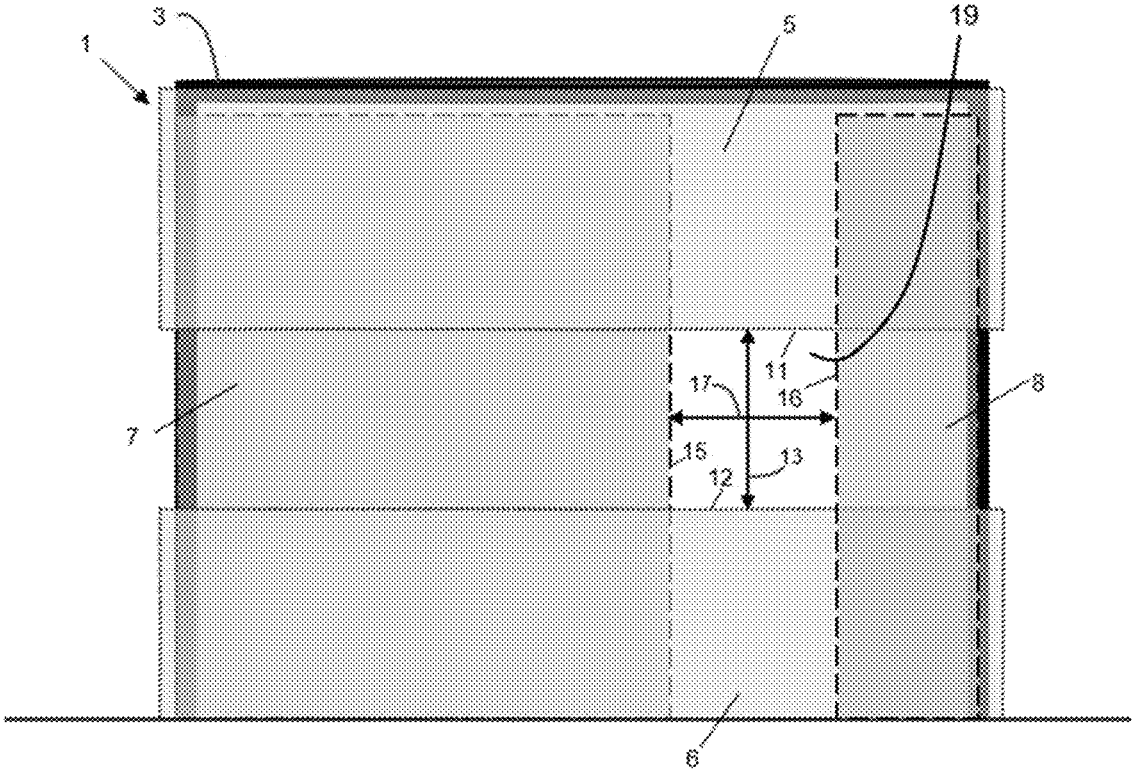
FIG. 2 is an illustrative view of the apparatus of FIG. 1 when the apparatus is in a partially open configuration.
Figure 3:
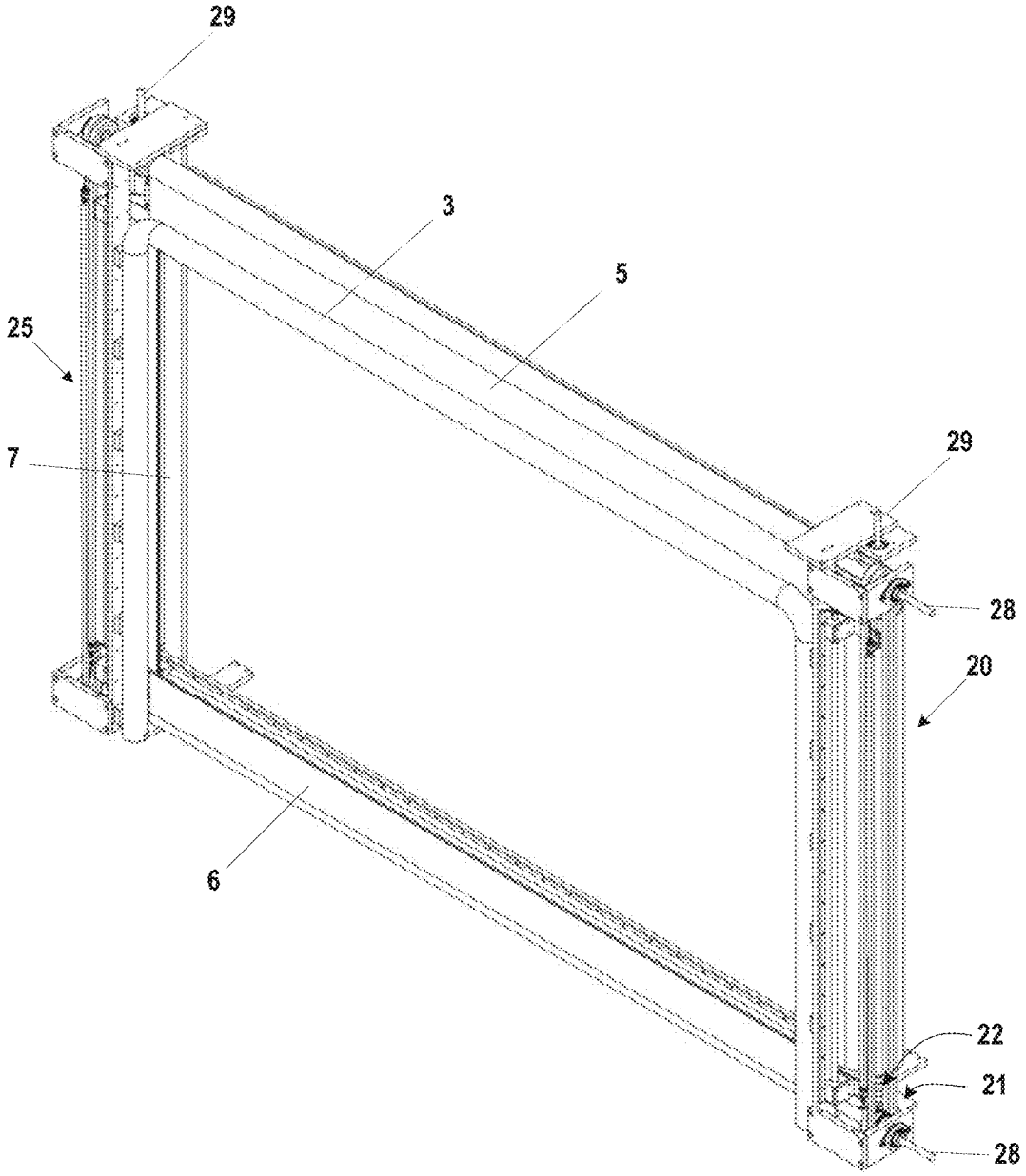
FIG. 3 is an illustrative view of an apparatus for improving and fine-tuning the scoring skills of a hockey player, according to one example.

Referring to FIGS. 1 and 2, there is shown an apparatus 1 for improving and fine-tuning the scoring skills of a player practicing on a goal having a frame 3. The apparatus 1 can be mounted on the goal frame 3 such that it is used in conjunction with the goal. The goal frame 3 has an opening 2. The opening 2 can be substantially rectangular. An alternative embodiment of the apparatus is shown in FIG. 3.

The apparatus 1 includes at least two movable blockers mounted on portions of the goal frame 3. Each of the blockers can have a pair of opposed free edges. The blockers can be shaped and sized to block the goal opening 2 when in a fully closed configuration. The blockers can be adapted to selectively define a target space within the goal opening 2 when in a partially open configuration.

Referring back to FIGS. 1 and 2, a first blocker includes a top panel 5 and a bottom panel 6. For example, the top panel 5 can be mounted on a top horizontal post of the goal frame 3, The top panel 5 can also be retractably mounted on the top horizontal post. For example, the bottom panel 6 can be mounted on a support resting across a bottom portion of the goal. The bottom panel 6 can be retractably mounted on the support. The support may be positioned below the goal frame 3 such that the support and the bottom panel 6 when fully retracted do not block the frame opening 2.

As shown in FIGS. 1 and 2, the top and bottom panels 5 and 6 have opposed sides. The top panel 5 includes a side having a free edge 11. The bottom panel 6 includes a side having free edge 12. The free edges 11 and 12 are opposed to each other. The free edges 11 and 12 define a free space 13 between them. The free edges 11 and 12 can be generally horizontal. For example, each of the top and bottom panels 5 and 6 can be moved such that the free edges 11 and 12 are movable to increase or decrease the free space 13 therebetween. For example, the free edges 11 and 12 can be moved in a vertical direction for vertically adjusting the free space 13. For example, each of the top and bottom panels 5 and 6 can be moved independently to position their corresponding free edge at various locations within the goal opening 2.

Referring to FIG. 3, the top and bottom panels 5 and 6 can be slidably mounted on a guiding mechanism 20 mounted to the goal frame 3. The guiding mechanism 20 can be used for actuating the top and bottom panels 5 and 6. The guiding mechanism 20 can include a first gear assembly 21, a second gear assembly 22, a motor (not shown) and a controller (not shown).

Figure 4:
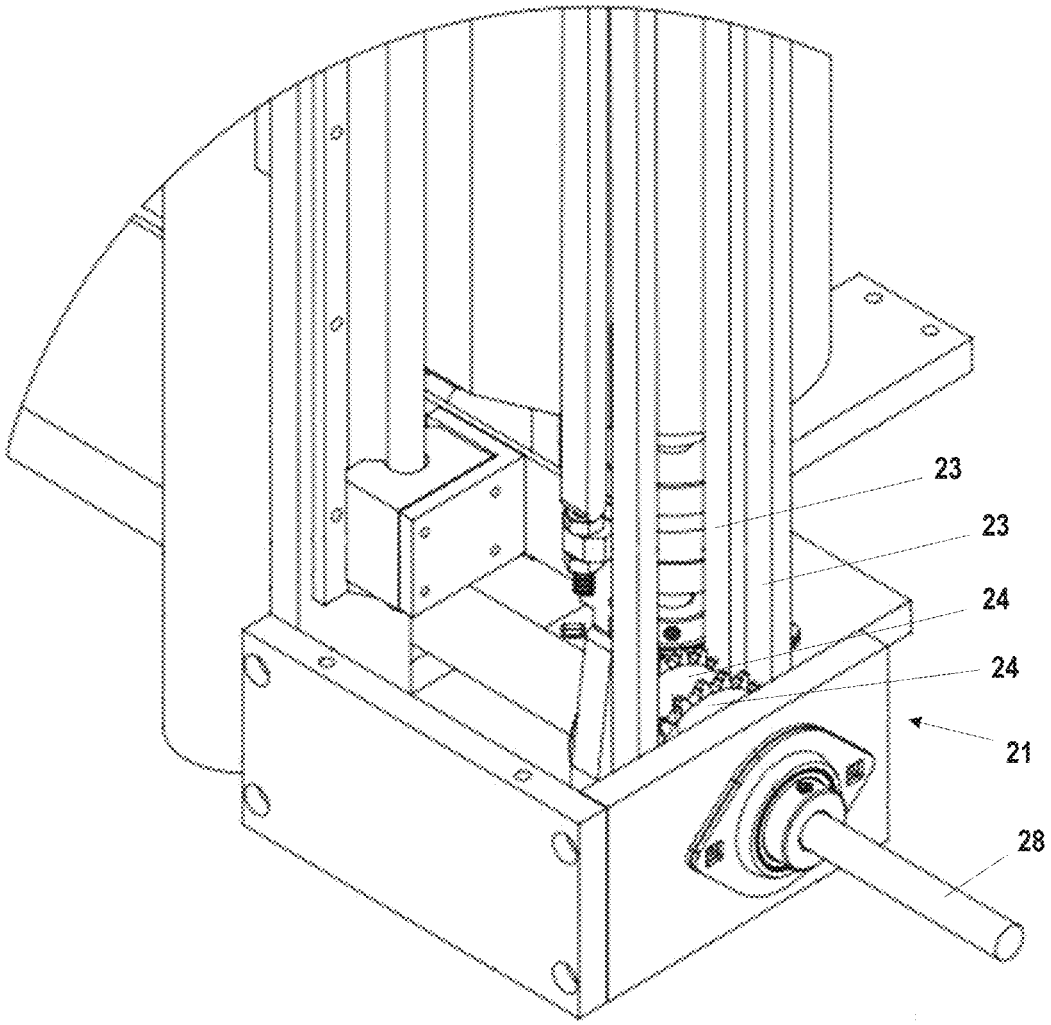
FIG. 4 is a detailed view of the guiding mechanism of the apparatus of FIG. 3.

FIG. 4 shows an exemplary embodiment of a bottom portion of the first gear assembly 21 of the guiding mechanism 20. The first gear assembly can have a pair of chains 23 and each one of the pair of chains 23 can be driven by gears 24. A portion of the top panel 5 can be mounted on one chain of the pair of chains 23 and a portion of the bottom panel 6 can be mounted on the other chain. The motor can mechanically rotate the gears 24 for driving said each one of the pair of chains 23 independently. The controller is electrically connected to the motor to control the motor and the operation of the guiding mechanism 20. For example, a user can use the controller to increase or decrease the free space between the top and bottom panels 5 and 6.

As shown in FIG. 3, in one embodiment, the apparatus 1 may include a second guiding mechanism 25. The second guiding mechanism 25 is substantially similar to the guiding mechanism 20, mounted to another side of the frame and preferably mirrored thereto.

In a preferred embodiment, each one of the top and bottom panels 5 and 6 can be mounted around a cylinder having an axis of rotation substantially parallel to the free edges 11 and 12. The cylinder can be biased to wrap each one of the top and bottom panels 5 and 6. Each of the top and bottom panels 5 and 6 can include a fabric. The fabric is preferably flexible, durable and resilient to impacts by objects. FIGS. 3 and 4 depict another embodiment where the apparatus 1 includes a pair of horizontal cylinders 28. The top panel 5 may be mounted around one of the pair of horizontal cylinders 28. The bottom panel 6 may be mounted around the other cylinder.

Referring back to FIGS. 1 and 2, a second blocker includes a left panel 7 and a right panel 8. The second blocker is perpendicular to the first blocker. For example, the left panel 7 can be mounted on a left vertical post of the goal frame 3 and the right panel 8 can be mounted on a right vertical post of the goal frame 3. Each one of the left and right panels 7 and 8 can be retractably mounted on their corresponding posts.

As shown in FIGS. 1 and 2, the left and right panels 7 and 8 have opposed sides. The left panel 7 includes a side having a free edge 15. The right panel include a side having free edge 16. The free edges 15 and 16 are opposed to each other. The free edges 15 and 16 define a free space 17 between them. The free edges 15 and 16 can be generally vertical. For example, each one of the left and right panels 7 and 8 can be moved such that the free edges 15 and 16 are movable to increase or decrease the free space 17 therebetween. For example, the free edges 15 and 16 can be moved in a horizontal direction for horizontally adjusting the free space 17. For example, each of the left and right panels 7 and 8 can be moved independently to position their corresponding free edge at various locations within the goal opening.

Referring to FIG. 3, the left and right panels 7 and 8 can be slidably mounted on the guiding mechanism 20 such that the guiding mechanism 20 is also used to actuate the left and right panels 7 and 8. The left and right panels 7 and 8 are actuated using the second gear assembly 22 of the guiding mechanism 20.

Figure 5:
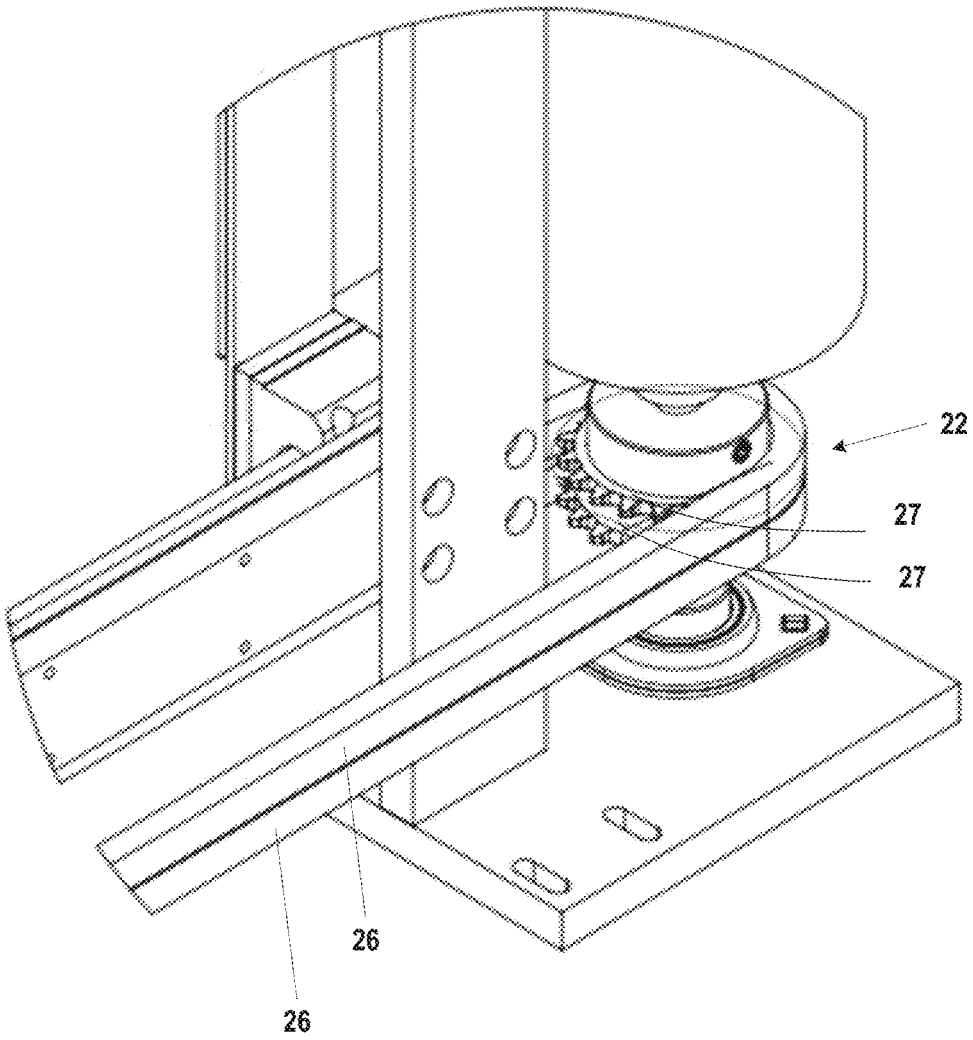
FIG. 5 is a detailed view of the guiding mechanism of the apparatus of FIG. 3.

FIG. 5 shows a detailed view of the second gear assembly 22 of the guiding mechanism 20. The second gear assembly 22 can have a pair of chains 26. Each one of the pair of chains 26 can be driven by gears 27. A portion of the left panel 7 can be mounted on one chain of the pair of chains 26 and a portion the right panel 8 can be mounted on the other chain. The motor can also mechanically rotate the gears 27 of the second gear assembly 22 for driving each one of the pair of chains 26 independently. The controller is electrically connected to the motor to control the motor and the operation of the guiding mechanism 20. For example, a user can use the controller to increase or decrease the free space between the left and right panels 7 and 8.

As shown in FIG. 2, the free space 13 and the free space 17 define a target space 19. In a preferred embodiment, by using the controller, a user can move the top, bottom, left and right panels 5, 6, 7 and 8 to vary the location, size and shape of the target space 19 to practice his shot. More precisely, not only can the user vary the size and shape of the target space 19 to a certain size hole wherever he wants (for e.g., top left, bottom left, etc.), but with this new concept, he can practice with a "horizontal or vertical" target space, therefore creating a personalized practice session. A horizontal target space is created when the left and right panels 7 and 8 are fully retracted and either the top or bottom panels 5 or 6 or both are at least partially extended. A vertical target space is created when the top and bottom panels 5 and 6 are fully retracted and either the left or right panels 7 and 8 or both are at least partially extended.

In another embodiment, the controller can automatically and randomly move the top, bottom, left and right panels 5, 6, 7 and 8 to vary the location, size and shape of the target space 19 during a practice session.

In a preferred embodiment, each one of the left and right panels 7 and 8 can be mounted around a cylinder having an axis of rotation substantially parallel to the free edges 15 and 16. The cylinder can be biased to wrap the left and right panels 7 and 8. Each one of the left and right panels 7 and 8 can include a fabric, which is preferably flexible, durable and resilient to impacts by objects. FIGS. 3 and 4 depict another embodiment where the apparatus 1 includes a pair of vertical cylinders 29. The left panel 7 may be mounted around one of the pair of vertical cylinders 29. The right panel 8 may be mounted around the other cylinder.

Figure 6:
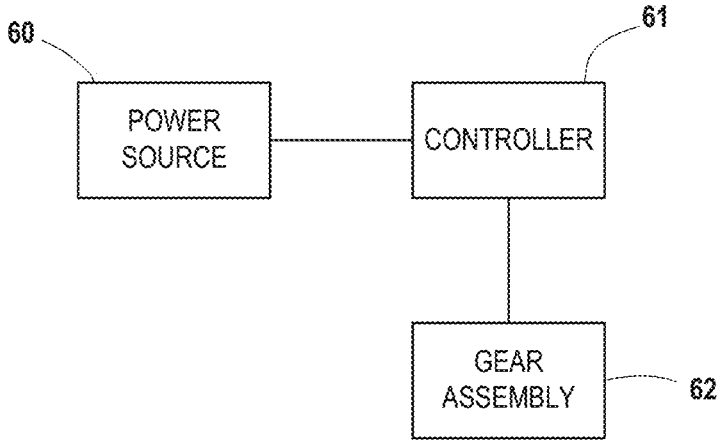
FIG. 6 is a block diagram of a guiding mechanism including a controller powered by a power source and coupled to a gear assembly.

FIG. 6 is a block diagram of a guiding mechanism including a power source 60 coupled to a controller 61. The controller 61 is coupled to a gear assembly 62. The controller 61 is operable to control the guiding mechanism.

The above embodiments are merely used for explaining the present disclosure, without introducing any limitations thereto. Modifications may be made by those skilled in the art to those embodiments without creative contribution if necessary upon reading the specification, and those modifications shall be protected by law as long as they fall into the scope defined in the appended claims of the present disclosure.

The invention claimed is:

1. An apparatus for use in conjunction with a goal having a frame defining an opening, the opening being substantially rectangular, the apparatus comprising:

at least two movable blockers shaped and sized to completely block said opening when in a fully closed configuration, said blockers being adapted to selectively define a target space within said opening when in a partially open configuration, wherein said at least two movable blockers comprises a first blocker and a second blocker; and the first blocker mounted on a portion of said frame, said first blocker having a pair of opposed first free edges, wherein when in an open or partially open configuration said first free edges are spaced apart in a vertical direction defining a first free space between said free edges, said opposed first free edges extending in a horizontal direction and being movable to increase or decrease the first free space therebetween, said first free edges being movable in the vertical direction to vertically adjust said first free space by moving the first free edges towards or away from one another in the vertical direction;

the second blocker mounted on another portion of said frame and being perpendicular to said first blocker, said second blocker having a pair of opposed second free edges, wherein when in an open or partially open configuration said second free edges are spaced apart in the horizontal direction defining a second free space between said second free edges, said opposed second free edges extending in the vertical direction and being movable to increase or decrease the second free space therebetween, the second free edges being movable in the horizontal direction to thereby adjust said second free space by moving the second free edges towards or away from one another in the horizontal direction;

wherein an overlapping free space defined by said first free space and said second free space defines said target space when in the partially open configuration.

2. The apparatus of claim 1, said first blocker comprising a top panel and a bottom panel, said top panel being retractably mounted on a top portion of said frame, said bottom panel being retractably mounted on a support resting across a bottom portion of said goal, said top and bottom panels having first opposed sides; and said second blocker comprising a left panel and a right panel, said left panel being retractably mounted on a first side portion of said frame, said right panel being retractably mounted on a second side portion of said frame, said left panel and said right panel having second opposed sides.

3. The apparatus of claim 2, wherein each of said top and bottom panels are mounted around a first cylinder having an axis of rotation substantially parallel to the first free edges, and each of said left and right panels are mounted around a second cylinder having an axis of rotation substantially parallel to the second free edges.

4. The apparatus of claim 3, wherein said first cylinder is biased to wrap said top and bottom panels and said second cylinder is biased to wrap said top and bottom panels.

5. The apparatus of claim 2, said top, bottom, right and left panels comprise flexible fabrics.

6. The apparatus of claim 2, comprising said top, bottom, left and right panels being slidably mounted on guides mounted to said goal.

7. The apparatus of claim 6, further comprising a guiding mechanism comprising a gear assembly, a motor, and a controller, the gear assembly having chains being driven by gears, said guides being mounted on the chains, the motor configured to mechanically rotate the gears for driving said guides; and the controller being electrically connected to the motor to control the operation of the guiding mechanism.

8. An apparatus for use in conjunction with a goal having a frame defining an opening, the opening being substantially rectangular, the apparatus comprising:

a top panel mounted to the frame;

a bottom panel mounted to the frame;

the top panel and bottom panel are operable to define a vertical free space therebetween;

the top panel and the bottom panel are adjustable between a first closed configuration and one or more first open configurations while mounted to the frame, wherein in any of the first open configurations the top panel and bottom panel are vertically spaced apart thereby defining the vertical free space;

a left panel mounted to the frame;

a right panel mounted to the frame;

the left panel and right panel are operable to define a horizontal free space therebetween;

the left panel and right panel are adjustable between a second closed configuration and one or more second open configurations while mounted to the frame, wherein in any of the second open configurations the left panel and right panel are horizontally spaced apart thereby defining the horizontal free space;

the top panel, bottom panel, left panel, and right panel are shaped and sized to completely block the opening when the top panel and the bottom panel are in the first closed configuration and the left panel and right panel are in the second closed configuration; and the top panel, bottom panel, left panel, and right panel are selectively adjustable to define a target space within the opening, wherein the target space is defined by an overlap between the vertical free space and the horizontal free space.

9. The apparatus of claim 8, wherein each of the top panel and the bottom panel are independently movable.

10. The apparatus of claim 8, wherein each of the left panel and the right panel are independently movable.

11. The apparatus of claim 8, further comprising a motor operable to drive the selective adjustment of the top panel, bottom panel, left panel, and/or right panel.

12. The apparatus of claim 11, further comprising a user-operated controller, wherein the controller is operable to control operation of the motor to drive adjustment of the top panel, bottom panel, left panel, and/or right panel to define a user-selected target space.

13. The apparatus of claim 11, further comprising a controller operable to control operation of the motor to drive adjustment of the top panel, bottom panel, left panel, and/or right panel to define the target space in the absence of user input specifying the target space.

14. The apparatus of claim 13, wherein the controller is operable to control the motor to define a random target space.

15. The apparatus of claim 8, further comprising a first chain and a second chain, wherein the left panel is mounted to the first chain and the right panel is mounted to the second chain.

16. The apparatus of claim 15, wherein motion of the first chain and/or the second chain drives the selective adjustment of the left panel and/or right panel.

17. An apparatus for use in conjunction with a goal having a frame defining an opening, the apparatus comprising:

a first blocker mounted on a portion of the frame, the first blocker having a pair of first retractable panels with opposed first free edges, the first retractable panels being adjustable between a first closed configuration and one or more first open configurations while the first blocker remains mounted to the frame, wherein in any of the first open configurations the first free edges are spaced apart defining a first free space between the first free edges, wherein the first free edges are movable towards and away from one another to respectively decrease or increase the first free space therebetween;

a second blocker mounted on another portion of said frame and being perpendicular to said first blocker, the second blocker having a pair of second retractable panels with opposed second free edges, the second retractable panels being adjustable between a second closed configuration and one or more second open configurations while the second blocker remains mounted to the frame, wherein in any of the second open configurations the second free edges are spaced part defining a second free space between the second free edges, wherein the second free edges are movable towards and away from one another to respectively decrease or increase the second free space therebetween;

wherein the first blocker and second blocker are shaped and sized to completely block the opening when the first blocker is in the first closed configuration and the second blocker is in the second closed configuration;

the first blocker and second blocker are adapted to selectively define a target space within the opening, the target space defined by an overlapping free space defined by the first free space and the second free space.

18. The apparatus of claim 17, wherein the first blocker comprises a top panel and a bottom panel, the top panel being retractably mounted on a top portion of said frame, the bottom panel being retractably mounted on a support resting across a bottom portion of the goal, the top and bottom panels having the opposed first free edges; and the second blocker comprising a left panel and a right panel, the left panel being retractably mounted on a first side portion of said frame, the right panel being retractably mounted on a second side portion of the frame, the left panel and the right panel having the opposed second free edges.

19. The apparatus of claim 18, wherein each of the top panel and the bottom panel are independently movable.

20. The apparatus of claim 18, wherein each of the left panel and the right panel are independently movable.

* * * * *